United States Patent [19]

Uttech

[11] 4,042,151

[45] Aug. 16, 1977

[54] BEVERAGE MIXING AND DISPENSING MACHINE

[75] Inventor: Raymond Uttech, Watertown, Wis.

[73] Assignee: KARMA division of BRANDT, Inc., Watertown, Wis.

[21] Appl. No.: 686,149

[22] Filed: May 13, 1976

[51] Int. Cl.[2] ..... B67D 5/56

[52] U.S. Cl. ..... 222/129.2; 222/318

[58] Field of Search ..... 222/129.1, 129.2, 129.3, 222/129.4, 133, 318, 193

[56] References Cited

U.S. PATENT DOCUMENTS 3,756,473 9/1973 Donahue, Jr. ..... 222/129.2

*Primary Examiner*—Stanley H. Tollberg

*Attorney, Agent, or Firm*—Ira Milton Jones & Associates

[57] ABSTRACT

A head for a beverage mixing and dispensing machine comprises a block having bores that define a water inlet connectable with a source of pressurized water, a concentrate inlet connectable with a substantially unpressurized concentrate source, and a venturi aspirator. Mixed water and concentrate flow from the aspirator to a holding chamber in the block that opens downwardly to an outlet spout. A recirculation passage in the block brings mixed liquid back to the aspirator from the holding chamber. Proportioning of concentrate to water is adjusted by a needle valve controlling communication between the holding chamber and the recirculation passage. The head block is readily removably locked to a cabinet that accommodates ducts and control mechanism.

15 Claims, 4 Drawing Figures

Fig. 2
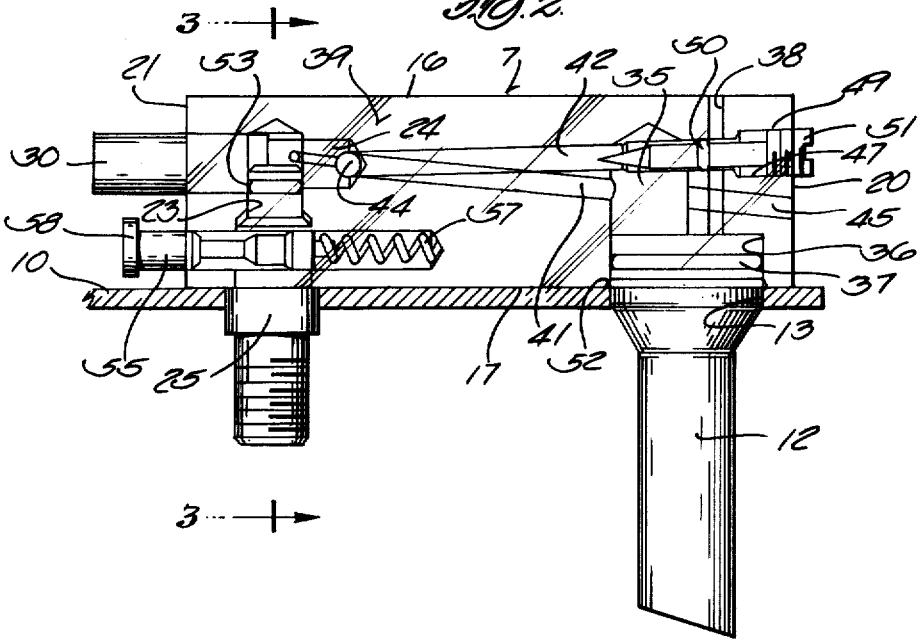
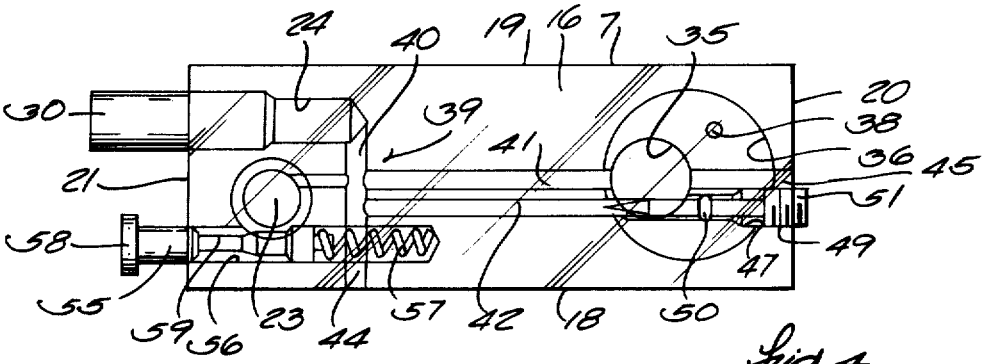
Fig. 4
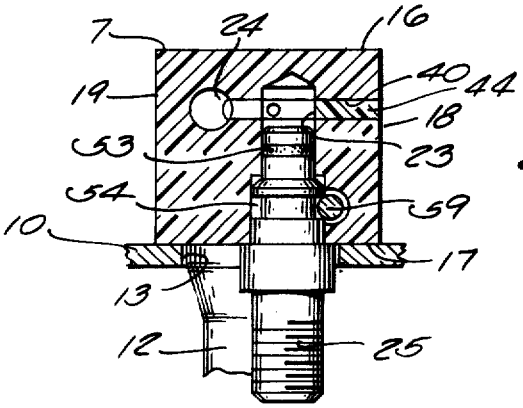
Fig. 3

BEVERAGE MIXING AND DISPENSING MACHINE

This invention relates to apparatus for mixing and dispensing non-alcoholic beverages, and the invention is more particularly concerned with a mixing and dispensing head which is removably securable to a beverage machine cabinet and which constitutes a more or less self-contained sub-unit whereby water from a pressurized source is mixed with a liquid beverage concentrate from a substantially unpressurized source and the mixture is dispensed directly into a consumer container.

A beverage dispensing machine of the type to which this invention relates is connected with a source of water and with a source of beverage concentrate in syrup form, and it dispenses mixed beverage downwardly into a consumer container such as a paper cup. Such a machine usually comprises a venturi aspirator at which water and beverage concentrate are mixed, and heretofore that aspirator has often taken the form of plumbing that was more or less built into the cabinet of the machine. In addition to concealing ducts and valves, the cabinet also accommodates a control mechanism for starting and stopping the dispensing operation and provides suitable locating and supporting means for the consumer container into which the machine dispenses.

One general object of the present invention is to provide a more or less self-contained dispensing head which is detachably securable to a beverage machine cabinet and connectable with water and concentrate sources, which head performs the functions of pumping concentrate, mixing it with water and dispensing the mixed beverage.

For a satisfactory beverage, the apparatus should closely and consistently control the ratio of beverage concentrate to water, so as to maintain a desired relationship between them. It should also provide for the adjustment of that proportioning, to accommodate local tastes and to adapt the machine for use with beverage syrups of widely varying concentrations.

In some prior apparatus for mixing and dispensing syrup-base beverages where syrup was not under pressure, a pump was connected between the source of concentrate and the mixing and dispensing means. The rate at which concentrate was pumped was controlled by adjusting either the speed at which the pump was driven or the displacement of the pump, and therefore the ratio of concentrate to water in the dispensed beverage could be regulated by such adjustment of the pump.

A pump has several disadvantages. It is expensive in itself; it consumes electric power; it tends to be relatively noisy; it requires occasional maintenance or repair; and its presence complicates cleaning of the dispensing apparatus. Heretofore, however, a pump has provided the most satisfactory expedient for controlling the proportion of concentrate in the mixed beverage.

It has been proposed to draw concentrate from an unpressurized source by means of an aspirator pump, and to regulate the proportion of concentrate in the mixed product by throttling the flow of concentrate. But regulation in this manner is always somewhat inaccurate and inconsistent because of the viscosity of the concentrate, and it tends to be markedly erratic if the concentrate contains any suspended particles, such as bits of fruit pulp. Furthermore, a throttling valve in the concentrate line may necessarily be so located that it is not readily accessible for adjustment, and it may tend to complicate cleaning of the apparatus.

Another requirement for a satisfactory mixing and dispensing machine for non-carbonate fruit flavored beverages relates to aeration of the mixed product. It is desirable that there be a certain amount of froth on the surface of the dispensed drink, both for eye appeal and to improve the flavor of the beverage. But the depth of the froth layer should not be excessive, and therefore it is important that the apparatus be capable of mixing just the right amount of air with the combined water and beverage concentrate.

Further requirements for a machine of the type under consideration relate to the maintenance of a prime at the venturi pump or aspirator in which water and concentrate are mixed. It is important that both of those liquids be present directly at the aspirator at all times between mixing operations, so that a properly mixed product is dispensed from the beginning of every operation of the machine. This means that neither water nor concentrate should flow back along its delivery duct when the machine is turned off, and of course there should be no siphoning back of mixed beverage into either of the delivery ducts. Nor should either of the liquids tend to trickle towards the dispensing outlet between operation cycles. Nevertheless, mixed beverage should be cleared out of the dispensing passage as quickly and completely as possible at the conclusion of a mixing cycle, and for this purpose it is necessary to provide a vacuum breaking expedient that will allow air to enter that passage and displace mixed beverage. But such air as is permitted to enter the mixed beverage passage should not be permitted to aerate the mixed beverage to such an extent as to render it excessively frothy.

With the above stated considerations in mind, it is the general object of the present invention to provide beverage dispensing apparatus of the character described that does not comprise a mechanical pump of any type, and wherein energy for bringing beverage concentrate from an unpressurized source thereof to the mixing zone is derived solely from the normal pressure of a tap-water supply system; but wherein simple and effective means are provided for adjustably controlling the ratio of concentrate to water in the mixed beverage without throttling of the flow of concentrate.

Another object of the invention is to provide a mixing and dispensing apparatus for beverages that effects very rapid and complete mixing of beverage concentrate and water and introduces air into the mixture at such a rate and in such a manner that the dispensed beverage is properly aerated for optimum flavor and has a controlled level of froth.

It is also an object of the invention to provide a mixing and dispensing head for a machine of the character described, which head comprises a unitary block that embodies an aspirator whereby liquid concentrate is drawn from a substantially unpressurized source, said head being arranged to maintain a prime at the aspirator, to clear itself rapidly of mixed beverage at the conclusion of a mixing and dispensing cycle, and to dispense a mixed beverage with a controlled amount of froth.

A further object of the invention is to provide a mixing and dispensing head of the character described that is of very simple and inexpensive construction and is very easily cleaned. In this connection it is specific object of the invention to provide a mixing head which comprises a unitary block of metal or plastic having various ports, passages and the like that can be readily formed therein by drilling.

Another specific object of the invention is to provide a mixing and dispensing head of the character described that comprises an aspirator pump having two education inlets, one of said education inlets being connectable with a source of beverage concentrate to enable concentrate to be drawn into water flowing through the aspirator and to be carried with the water to a holding chamber, and the other said education inlets being communicated with a recirculation passage that leads back to the aspirator from the holding chamber, the communication between the holding chamber and the recirculation passage being adjustably controllable by means of a metering valve, and recirculation of a regulated amount of mixed water and concentrate providing for control of the relative proportions of water and concentrate being mixed while ensuring a complete and thorough mixing of the water and concentrate.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which:

FIG. 2 is a view in side elevation of a mixing and dispensing head of the machine shown in FIG. 1, in its relation to portions of the cabinet to which it is attached;

FIG. 3 is a view in vertical section taken on the plane of the line 3—3 in FIG. 2; and FIG. 4 is a top view of the dispensing head shown in disassembled relation to the cabinet.

Figure 1:
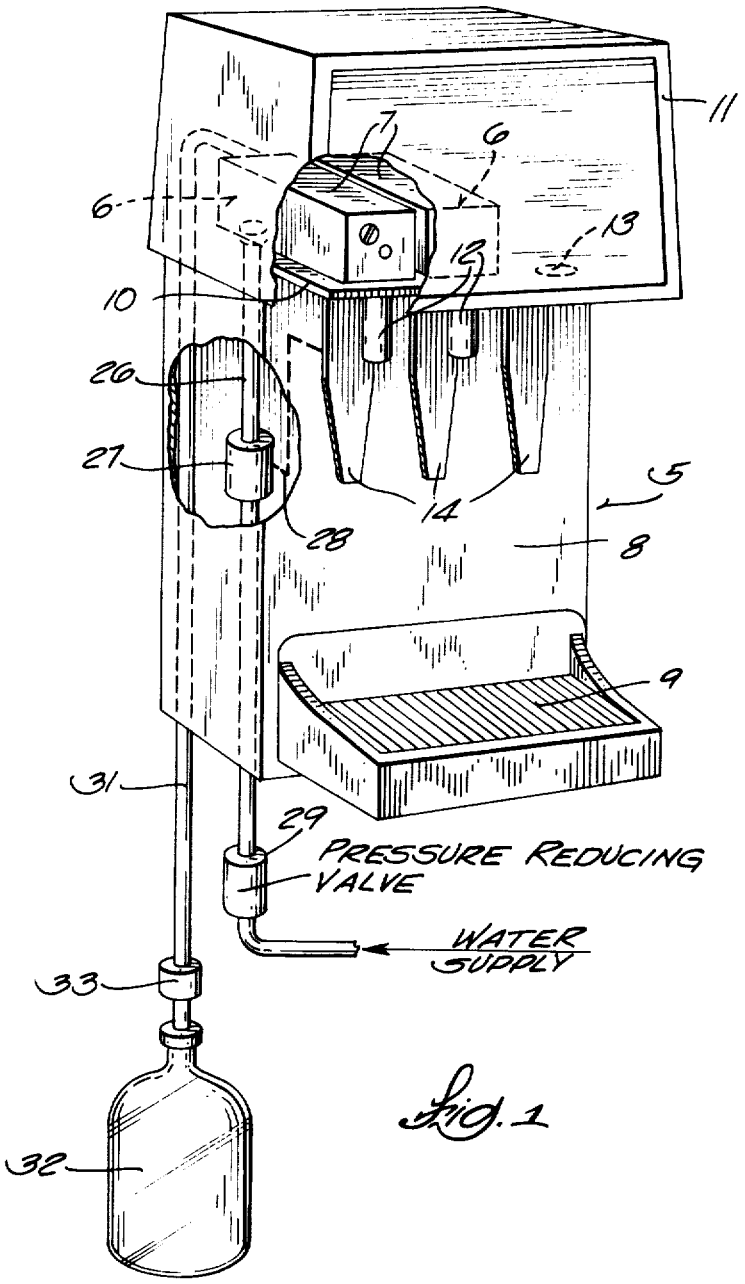
FIG. 1 is a front perspective view of a beverage mixing and dispensing machine embodying the principles of this invention, with a portion of its cabinet shown broken away.

Referring now to the accompanying drawings, the numeral 5 designates generally a beverage dispensing machine cabinet on which there are mounted mixing and dispensing heads 6 embodying the principles of the present invention. In the present case the machine is intended to be equipped with three of the dispensing heads 6, so that it can dispense beverages of three different flavors; however, only two of the heads are shown in place.

The machine cabinet 5 is an upright, box-like structure that encloses certain tubes and valves, as described hereinafter. Projecting forwardly from its front wall 8, at the bottom thereof, is a generally conventional drip tray and container support 9 upon which paper cups or similar containers (not shown) are intended to be placed for filling with beverage dispensed by the machine.

The top wall 10 of the cabinet 5 has a flat top surface, and its front portion projects, shelf-fashion, a substantial distance beyond the front wall 8 to overhang the drip tray 9. Each of the mixing and dispensing heads 6 comprises an elongated body 7 that lies flat on the top surface of the top wall. A removable ornamental cover 11 can cooperate with the top wall of the cabinet to conceal the heads and the connections to them and to enhance the appearance of the cabinet.

In addition to the block 7, each head 6 further comprises a delivery spout 12 that projects downwardly through a hole 13 in the forwardly projecting portion of the top wall.

Directly behind each spout there is a control lever 14 that projects down from the top wall to a level below the bottom of the spout. Each control lever is mounted for limited swinging about its upper end, towards and from the front wall 8 of the cabinet, and is biased towards a forward "off" position. As a container is set in place beneath a spout 12, the adjacent control lever is of course pushed rearwardly, to cause a drink to be mixed and dispensed into the container.

The block 7 that comprises the body of each mixing and dispensing head 6 is preferably formed in one piece, of metal or plastic. Clear acrylic is especially suitable, not only from the standpoint of manufacturing facility but also because the condition of all interior surfaces in a transparent block can be seen at a glance so that the existence of an unsanitary condition reveals itself conspicuously.

The head block 7 can be rectangular and substantially elongated horizontally. It has flat, parallel top and bottom surfaces 16 and 17, respectively; lengthwise extending, substantially upright side surfaces 18 and 19; and upright front and rear end surfaces 20 and 21.

As shown, the block has a vertical blind bore 23 that opens to its bottom surface to provide a water inlet, and it has a horizontal blind bore 24 that opens to its rear surface and provides a concentrate inlet. Each of the blind bores 23 and 24 had an enlarged diameter outer portion in which a fitting is receivable for connecting the head with sources of water and of concentrate.

The cabinet 5 has three rigid water inlet fittings 25, each projecting upwardly from its top wall 10 to be received in the blind bore 23 in a head block. As explained hereinafter, each head block is removably held in place on the cabinet by being releasably secured to a water inlet fitting and by having its spout 12 received in a hole 13 in the shelf-like projecting portion of the cabinet top wall.

A pressurized water supply — which can be a source of tap water — is connected with each water inlet fitting 25 by duct means comprising a hose 26 or the like that extends upwardly through the cabinet. In the water supply duct for each head there is a water valve 27 that is controlled from the control lever 14 directly beneath the head. The connection 28 between each control lever 14 and its water valve 27, indicated only schematically, can be either a direct mechanical one or an electrical one that comprises a switch actuated by the lever and an electromagnetic actuator for the water valve.

Preferably there is a pressure reducing valve 29 in the water supply duct, to ensure that water is supplied to each head at a predetermined and substantially constant pressure which is slightly below the lowest expectable tap water pressure value. All machines equipped with such a pressure reducing valve will operate uniformly and consistently on any tap water system.

The concentrate inlet fitting 30 can be a nipple in the form of a straight length of tubing that has one end portion sealingly received in the larger diameter portion of the horizontal blind bore 24 in the head block. The concentrate duct can comprise a hose 31 that extends up through the cabinet and is fitted over the projecting outer end portion of the nipple 30. At its lower end the concentrate duct is communicated with a substantially unpressurized source of beverage concentrate, which can comprise the container 32 in which the concentrate is purchased, located under a counter or the like on which the cabinet is mounted. There is a check valve 33 in the duct that communicates the concentrate source 32 with the concentrate inlet 24 in the head, to maintain a priming column of concentrate all along that duct and into the head, so that mixing can begin as soon as water starts to flow through the head.

When the machine is in operation, water and beverage concentrate, mixed as will be explained hereinafter, flow to a holding chamber 35 in the head block, near its front end, and thence downwardly into an outlet well 36, or, more specifically, into the upper end of the spout 12 that projects downwardly from the block. The outlet wall 36, which opens to the bottom surface 17 of the block and is located near its front surface 20, is rather short axially and has a relatively large diameter. The upper end portion of the spout 12, which is removably confined in the cylindrical outlet well, has a cylindrical external surface, but it has a circumferential groove around it in which an O-ring 37 is seated. The O-ring is under radical compression between the spout and the side surface of the well to provide a seal between them and to enable the spout to be installed in the well and removed therefrom by the exertion of a moderate axial force. To facilitate insertion of the spout and compression of the O-ring, the side surface of the well has a chamfer 52 around its lower edge.

The holding chamber 35 is in the form of a well that opens downwardly into the outlet well. The axial depth of the holding chamber is somewhat greater than that of the outlet well, but its diameter is substantially smaller, and the axis of the holding chamber is spaced a substantial distance to one side of the axis of the outlet well. It will be evident that the holding chamber can be readily formed in the head block by simply drilling a distance upwardly into the block from the top or end surface of the outlet well.

A small diameter air bleed passage 38 in the block opens to its top surface and to the top surface of the outlet well at a location spaced from the holding chamber. The air bleed passage admits air to the upper portion of the spout 12, to break the vacuum there so that mixed beverage will drop freely out of the spout after the flow of water is cut off. A small amount of the air admitted through the air bleed tends to mix with beverage issuing from the spout, to enhance its flavor by aeration and to product some of the limited amount of froth that appears on the surface of the dispensed drink.

Concentrate is pumped up from the source 32 and is mixed with water by means of an eductor or aspirator 39 that is defined by three straight small diameter bores 40, 41 and 42 which are drilled into the head block. These bores also define certain passages in the block, as explained hereinafter.

Of the three bores just mentioned, the one designated by 40 extends transversely to the length of the block and is shown as oriented horizontally. It is drilled into the block from the side surface 18 thereof, near the rear end of the block, and it terminates in the blind bore 24 that serves as the concentrate inlet, at the inner end thereof. The transverse bore 40 defines a pair of eduction inlets to the aspirator 39.

The small diameter bore 41 is drilled substantially lengthwise into the block from its front surface 20 and has a slight upward inclination towards the rear of the block. The axis of the bore 41 is in substantially transverse intersecting relation to the axis of the holding chamber 35. In continuing rearwardly from the holding chamber, the bore 41 intersects the transverse bore 40 and terminates in the blind bore 23 that serves as the water inlet, near the inner end thereof. The rear portion 43 of the bore 41, extending from the water inlet blind bore 23 to the transverse bore 40, has a reduced diameter to define a venturi of the aspirator 39, through which water flows from the water inlet 23 past the eduction inlets defined by the transverse bore 40. The bore 41 also defines a mixture passage which is continuous with the aspirator venturi and through which the venturi feeds into the holding chamber 35.

The third small diameter bore, designated 42, extends generally rearwardly in the block from its front surface but has a slight downward inclination towards the rear of the block. It is tangent to the holding chamber to communicate with the same at one side thereof, and it terminates in the transverse bore 40. The bore 42 comprises a recirculation passage through which a certain amount of mixed water and concentrate can be drawn back from the holding chamber into the aspirator, by way of one of the eduction inlets defined by the transverse bore 40. Note that the transverse bore 40 communicates with the concentrate inlet 24 and with the longitudinal bore 42, respectively, at opposite sides of the venturi 41.

The outer end portion of the transverse bore 40, from its junction with the bore 42 to the side surface 18 of the head block, is filled by a plug 44. Similarly, the front portion of the longitudinal mixture passage bore 41, between the front surface 20 of the block and the holding chamber 35, is filled by a plug 45.

The longitudinal recirculation bore 42 has a counterbore or enlarged diameter outer portion 47 extending between its junction with the holding chamber and the front surface of the block. The outer portion of this counterbore is threaded to cooperate with the body of a needle valve 49 that adjustably controls communication between the holding chamber 35 and the portion of the bore 42 that extends rearwardly therefrom. The shoulder defined by the junction of the counterbore 47 with the bore 42 proper serves as a seat for the needle valve. An O-ring 50, seated in a circumferential groove in the needle valve body, seals off the portion of the counterbore 47 that is forward of the holding chamber 35.

The aspirator 39 of course comprises the intersecting portions of the bores 40, 41 and 42. It will be evident that the transverse bore 40, in its intersecting relation to the venturi defined by the bore 41, defines eduction inlets at opposite sides of that venturi. Because the transverse bore 40 is communicated at its inner end with the concentrate inlet 24, concentrate is sucked through one of the education inlets just mentioned, to be mixed with water flowing through the venturi. At the other eduction inlet mixed water and concentrate is drawn back through the recirculation passage 42 from the holding chamber.

To the extent that the recirculated mixture is drawn into the water stream at the aspirator, the induction of concentrate into that stream is diminished. Hence the ratio of concentrate to water in the mixed beverage is simply and easily controlled by adjustment of the needle valve 49 that controls communication between the holding chamber and the recirculation passage. If the needle valve is opened to increase the flow of recirculated fluid, the proportion of concentrate in the mixed product is reduced, whereas closing down the needle valve causes the mixed product to contain a higher proportion of concentrate.

The needle valve head 51 can be slotted for adjustment by means of a screwdriver, or can be formed as a knob or the like, but in any case it is accessible for adjustment at the front of the block, so that regulation of the concentrate mixture ratio can be accomplished with the utmost convenience.

Recirculation of mixed concentrate and water back through the recirculation passage 42 affords additional benefits in ensuring a complete mixing of water and concentrate and in effecting some aeration of the mixed beverage without producing an excessively frothy drink. A certain amount of air enters the recirculation passage along with liquid, especially at the beginning of a dispensing cycle, before the holding chamber 35 has been filled. However, as the operation continues and the holding chamber fills and remains substantially full, only a relatively small amount of air is recirculated with the liquid and therefore, in the receiving container, air bubbles in the initial output of frothy liquid must rise through substantially non-frothy liquid later delivered, aerating the entire drink. The small amount of air that enters the recirculation passage after the holding chamber is substantially filled is that which has followed a rather tortuous path, down into the outlet well from the air bleed passage 38 and then across the top surface of that well to the outlet of the holding chamber, thence upwardly in the holding chamber against the downward flow of mixed liquid in it. Thus air is so mixed with the liquid as to assure a thorough aeration of the dispensed drink without producing excessive froth.

In connection with the fact that the mixture passage 41 and the recirculation passage 42 are both slightly inclined to the horizontal, but in opposite directions, it will be observed that the recirculation passage 42 is communicated with the holding chamber near the top thereof, while the mixture passage 41 communicates with the holding chamber at a lower level, intermediate its top and its bottom. One result of this arrangement is the controlled aeration and frothing of the mixed product that has just been described, inasmuch as the mixed liquid initially entering the holding chamber from the mixture passage traps a limited amount of air in the top of that chamber, whence it can be recirculated back to the aspirator.

Another important result of this inclination of the passages 41 and 42 is that they can cooperate with the holding chamber to be self-draining without causing loss of priming head and without inducing back siphoning. Upon closure of the water valve 27 and cessation of water flow, the holding chamber promptly empties itself down into the outlet well and through the spout, because vacuum in the upper portion of the spout is broken by the air bleed passage 38. Air can then enter the upper (i.e., forward) end of the recirculation passage 42 to enable liquid to flow down along the recirculation passage to the transverse bore 40, and thence forwardly and downwardly in the mixing passage 41 to the holding chamber. However, because the passages 41 and 42 have a small diameter and only a slight inclination, drainage from them takes place rather slowly so that for all practical purposes there is a vacuum condition at the aspirator inlets.

It will be apparent that, other things being equal, the amount of froth on a drink mixed by the machine is controlled by the size of the holding chamber 35 and by the diameter of the air bleed passage 38. Increasing the size of the holding chamber causes more air to be entrapped in it during the initial portion of a mixing cycle and thus increses the forthiness of a mixed beverage. Frothiness also varies to some extent with the diameter of the air bleed passage 38, but it must be born in mind that the minimum diameter of that passage is controlled by considerations of ease of cleaning of the head and by the need for the spout to empty quickly at the conclusion of a mixing cycle.

Because the head 6 is readily removable from the cabinet 5 and the spout 12 is easily withdrawn from the outlet well in the block 7, the head can be cleaned easily and effectively. Since the connection between the concentrate hose 31 and the concentrate inlet fitting 30 is in a low pressure duct, that connection can be readily arranged to be easily made and broken. The block can also be readily connected with and disconnected from the water inlet fitting 25, which has a circumferential groove near its top wherein there is seated an O-ring 53 that provides a seal between the fitting and the surface of the water inlet bore 23.

For readily releasably locking the head 6 to the cabinet 5, the water inlet fitting 25 has a reduced diameter neck portion 54 a little distance below the O-ring 53, which neck portion cooperates with a locking plunger 55 that is axially slidable in a horizontal blind bore 56 in the block 7, opening to its rear surface 21. By means of a compression spring 57 seated in the inner portion of the blind bore 56, the plunger 55 is biased rearwardly towards a normal locking position in which its rear end portion projects a distance behind the rear surface of the block to provide a pushbutton 58. The plunger bore 56 intersects the water inlet bore 23 so that when the plunger 55 is in its locking position it can engage in the neck 54 on the water inlet fitting to cooperate with that fitting in locking the block into secure flatwise engagement with the top wall 10 of the cabinet.

Forward displacement of the plunger, against the bias of its spring 57, brings a reduced diameter portion 59 of the plunger into register with the water inlet fitting and allows the head block to be removed from the cabinet or installed thereon. To prevent rotation of the head block about the water inlet fitting, the spout 12 is received with a close but easy fit in the hole 13 in the shelf portion of the cabinet top wall.

From the foregoing description taken with the accompanying drawings it will be apparent that this invention provides a mixing and dispensing head for a beverage machine of the character described that is inexpensive, efficient and sanitary, obviates the need for a mechanical concentrate pump but provides for accurate regulation of the proportioning of water and concentrate, and produces a mixed beverage that has a controlled layer of froth on its surface.

Those skilled in the art will appreciate that the invention can be embodied in forms other than as herein disclosed for purposes of invention.

The invention is defined by the following claims:

I claim:

1. A mixing and dispensing head for a beverage dispensing apparatus, by which water from a pressurized source thereof can be mixed with liquid beverage concentrate from a substantially unpressurized source thereof and delivered to a consumer container beneath the head, said mixing and dispensing head being characterized by:

A. structure defining 1. a water inlet connectable with a source of water under pressure,
2. a concentrate inlet connectable with a source of beverage concentrate, and
3. a holding chamber having a downwardly opening outlet;

B. aspirator means defining
1. a venturi passage having an inlet communicated with said water inlet and an outlet communicated with said holding chamber, and
2. first and second eduction inlets opening into said venturi passage and from which fluid can be drawn into said venturi passage in consequence of flow of water therethrough; and C. passage defining means providing
1. a concentrate passage communicating said concentrate inlet with said first eduction inlet to enable concentrate to be educted into a stream of water flowing through the venturi passage and carried therewith into the holding chamber, and
2. a recirculation passage
a. having one end communicated with said second eduction inlet, and
b. having its other end in restricted communication with said holding chamber, said recirculation passage thus causing a portion of the combined water and concentrate conducted to the holding chamber to be recirculated back to the venturi passage for limiting the proportion of concentrate educted into water flowing through said venturi passage.

2. The mixing and dispensing head of claim 1, further characterized by:

D. an adjustable metering valve at said other end of the recirculation passage for controlling communication between the holding chamber and the recirculation passage and thereby controlling the proportion of concentrate educted into water flowing through the venturi passage.

3. The mixing and dispensing head of claim 1, further characterized by:

said structure further defining
1. downwardly opening outlet well having a diameter larger than that of the holding chamber and into the top of which the holding chamber opens substantially unrestrictedly, the axis of said outlet well being spaced a substantial distance to one side of the axis of the holding chamber, and
2. an air bleed inlet opening to the top of said outlet well at a location spaced from the opening of said holding chamber thereinto.

4. The mixing and dispensing head of claim 3, further characterized by:

an outlet spout having an upper end portion sealingly but removably secured in said outlet well and which projects downwardly from said structure.

5. A mixing and dispensing head for a beverage dispensing apparatus by which water from a pressurized source thereof can be mixed with liquid beverage concentrate from a substantially unpressurized source thereof and delivered to a consumer container beneath the head, said mixing and dispensing head being characterized by:

A. an elongated body block having
1. lengthwise extending top and bottom surfaces,
2. substantially upright lengthwise extending side surfaces, and
3. substantially upright front and rear surfaces, said block further having
4. an outlet opening to its bottom surface, near its front surface,
5. A well-like holding chamber which is smaller in diameter than the outlet well and opens downwardly into the latter, the axis of said holding chamber being spaced to one side of the axis of the outlet well,
6. a restricted air inlet opening to the top of said outlet well in spaced relation to the opening of said holding chamber thereinto,
7. a water inlet opening to one face of the block near the rear thereof and connectable with a source of pressurized water,
8. a concentrate inlet opening to a face of the block near the rear thereof, in spaced relation to said water inlet, said concentrate inlet being connectable with a source of beverage concentrate, and
9. bores in said block defining
a. an eductor having
1. a venturi passage that has an inlet communicated with said water inlet and an outlet communicated with said holding chamber,
2. a first eduction inlet communicated with the concentrate inlet to enable concentrate to be educated into water flowing through the venturi passage and mixed with it in passing to the holding chamber, and
3. a second eduction inlet,
b. a recirculation passage communicating said holding chamber with said second eduction inlet to provide for partial recirculation of mixed water and concentrate back to the venturi, said recirculation passage being defined by a bore that extends substantially lengthwise in the block, opens to said front surface of the block, and intersects said holding chamber;

B. an adjustable metering valve in the front end portion of the last mentioned bore, accessible for adjustment at the front surface of the block and which adjustably restricts communication between the holding chamber and the recirculation passage to provide for adjustment of the relative proportion of concentrate in beverage mixture dispensed by the device; and C. a substantially tubular outlet spout having an upper end portion sealingly received in said outlet well and which projects downwardly from the block to conduct mixed beverage from said block to a consumer container therebeneath.

6. The dispensing head of claim 5, further characterized by:

D. an O-ring compressively confined between cylindrical surfaces in said outlet well and on an upper end portion of said spout, to seal the spout to the block and to enable to spout to be axially inserted into and withdrawn from the block.

7. A machine for mixing beverage concentrate with water and dispensing the mixture into a consumer container, said beverage machine comprising:

A. a cabinet on which are mounted control means for effecting starting and stopping of a mixing and dispensing operation and which encloses at least two ducts connectable, respectively, with a source of water under pressure and a substantially unpressurized source of beverage concentrate, said cabinet having 1. a flat surface at an upper portion thereof and
2. a rigid fitting which is connected with one of said ducts and which projects outwardly from said surface with its axis perpendicular thereto;

B. a unitary block providing a mixing and dispensing head removably mounted on said cabinet, said block having
1. one flat surface portion which is flatwise engaged with said one flat surface on the cabinet,
2. a first inlet bore opening to its said one flat surface portion in which said fitting is sealingly but axially removably receivable to confine the block against translatory displacement in directions parallel to its said flat surface portion,
3. a second inlet bore in which there is a nipple releasably connected with the other of said ducts,
4. a downwardly opening substantially cylindrical outlet well opening to a bottom surface of the block and spaced a substantial distance from said first and second inlet bores, and
5. other bores communicated with said first and second inlet bores and with said outlet well and defining an aspirator by which concentrate can be educted by and mixed with a stream of water flowing from one of said inlet bores to the outlet well;

C. a substantially tubular dispensing spout having a cylindrical upper portion received in said outlet well with a sealing fit, but axially removable therefrom; and D. releasable locking means for
1. confining the block against movement away from said one flat surface on the cabinet and
2. confining the block against rotation about said fitting.

8. The beverage mixing and dispensing machine of claim 7 wherein said flat surface on the cabinet is the upper surface of a top wall thereof, said flat surface portion on the block is a bottom surface thereof, and said means for confining the block against rotation about said fitting comprises:

an edgewise extension of said top wall that projects forwardly beyond a front wall of the cabinet and in which there is a hole wherein the spout is received with a close but axially slidable fit.

9. In a beverage mixing and dispensing machine of the character described:

A. means defining a venturi passage having
1. an inlet connectable with a source of water under pressure,
2. an outlet, and
3. a pair of eduction inlets, from each of which liquid can be educted into a stream of water flowing through said venturi passage from its inlet to its outlet;

B. means defining a concentrate inlet communicable with a source of liquid beverage concentrate and communicated with one of said eduction inlets, to enable concentrate to be drawn from said source and mixed with a stream of water flowing through said venturi passage;

C. means defining a holding chamber communicated with the outlet of said venturi passage to receive mixed concentrate and water therefrom, said holding chamber having a downwardly opening outlet;

D. a spout beneath said holding chamber and into an upper portion of which the outlet of said holding chamber opens; and E. means defining a recirculation passage providing limited communication between said holding chamber and the other eduction inlet, for recirculating a predetermined amount of mixed water and concentrate back to the venturi passage to thereby control the rate at which concentrate is educted into water flowing through said venturi passage.

10. A beverage mixing and dispensing machine of the type comprising aspirator means defining a venturi passage that has an inlet communicable with a source of water under pressure and an outlet, said aspirator means also defining an eduction inlet opening to said venturi passage and communicable with a source of liquid beverage concentrate to enable a stream of water flowing through said venturi passage to mix with concentrate from said source, said machine also having means communicating said outlet of the venturi passage with a spout through which a mixture of water and concentrate is discharged from the machine, said machine being characterized by:

A. said means communicating the outlet of said venturi passage with said spout comprising means defining a holding chamber into which said outlet of the venturi passage opens and which opens downwardly into an upper portion of said spout;

B. said aspirator means defining a second eduction inlet opening to said venturi passage; and C. means defining a recirculation passage providing restricted communication between said holding chamber and said second eduction inlet, whereby mixed water and concentrate is drawn back from the holding chamber to the venturi passage at a controlled rate to control the rate at which concentrate is educted into the venturi passage from the first mentioned eduction inlet.

11. The machine of claim 10, further characterized by:

D. adjustable throttling valve means operatively associated with said means defining the recirculation passage, for regulating the rate at which mixed water and concentrate is drawn back through said recirculation passage and thereby regulating the proportions of water and concentrate in beverages dispensed by the machine.

12. The machine of claim 10, further characterized by:

D. means defining a restricted air bleed inlet extending downwardly into said upper portion of said spout to enable liquid to flow out of the spout and the holding chamber promptly upon termination of flow of water through the venturi passage.

13. The machine of claim 10, further characterized by:

D. said recirculation passage being communicated with said holding chamber at a level above that at which said outlet of the venturi passage is communicated therewith.

14. A beverage mixing and dispensing machine of the type comprising a cabinet that supports means defining an aspirator for mixing water from a pressurized source thereof with liquid beverage concentrate from a source thereof, control means by which a mixing and dispensing cycle can be started and stopped, and a downwardly projecting spout which is communicated with said aspirator means and from the lower end of which mixed water and concentrate issues during a mixing and dispensing cycle, said machine being characterized by:

A. the cabinet having a flat surface area at an upper portion thereof;

B. a substantially rigid fitting on the cabinet, connectable with one of said sources and projecting outwardly from said surface area with its axis perpendicular thereto;

C. a unitary block-like body having 1. a flat surface portion which is flatwise engagable with said surface area on the cabinet,
2. a first inlet bore opening to said flat surface portion and in which said fitting is removably receivable with a sealing fit,
3. a second inlet bore, and
4. a cylindrical well spaced from both of said inlet bores and opening to a bottom surface on said body;

D. means on said body providing for a readily disconnectable communication between said second inlet bore and the other one of said sources;

said mixing aspirator being defined by bores in said block-like body that are communicated with said inlet bores and with said cylindrical well;

F. said spout comprising tubular member having a substantially cylindrical upper portion that is axially insertably and removably received in said well; and G. cooperating means on the cabinet and on the block-like body for readily releasably confining the body against rotation about the axis of the fitting and against axial motion relative to said fitting that would carry said surface portion on the body out of flatwise engagement against said surface area on the cabinet.

15. The beverage mixing and dispensing machine of claim 14 wherein said block-like body is made of a transparent material so that the sanitary condition of its interval surfaces is readily visible.

* * * * *